US005910399A

United States Patent [19]

Schell et al.

[11] Patent Number: 5,910,399

[45] Date of Patent: Jun. 8, 1999

[54] BACKING LAYER FOR MOTION PICTURE FILM

[75] Inventors: Brian A. Schell, Honeoye Falls; Charles C. Anderson, Penfield, both of N.Y.

[73] Assignee: Eastman Kodak Company, Rochester, N.Y.

[21] Appl. No.: 09/090,831

[22] Filed: Jun. 4, 1998

[51] Int. Cl.[6] ..... G03C 1/85; G03C 1/825; G03C 1/76

[52] U.S. Cl. ..... 430/517; 430/510; 430/522; 430/527; 430/531; 430/539; 430/934; 430/961; 430/642

[58] Field of Search ..... 430/510, 517, 430/522, 527, 531, 934, 961, 539, 536

[56] References Cited

U.S. PATENT DOCUMENTS

| | | | |
|---|---|---|---|
| 5,066,572 | 11/1991 | O'Connor et al. | 430/531 |
| 5,679,505 | 10/1997 | Tingler et al. | 430/531 |
| 5,786,134 | 7/1998 | Nair et al. | 430/536 |
| 5,804,360 | 9/1998 | Schell et al. | 430/531 |

OTHER PUBLICATIONS

Copending, commonly assigned US Patent Application Serial No. 08/856,711, filed May 15, 1997.

*Primary Examiner*—Richard L. Schilling
*Attorney, Agent, or Firm*—Carl F. Ruoff

[57] ABSTRACT

The present invention is a motion picture film which includes a support having, in order, on one side thereof an antihalation undercoat and at least one silver halide emulsion layer and having, in order, on the opposite side thereof an antistatic layer and a protective overcoat. The protective overcoat includes a polyurethane binder having a tensile elongation to break of at least 50% and a Young's modulus measured at a 2% elongation of at least 50000 lb/in$^2$, and a topcoat farthest from the support. The topcoat is formed by the coating and subsequent drying of a coating composition comprising gelatin-grafted polyurethane comprising gelatin covalently bound to a polyurethane through a grafting agent, wherein the ratio of gelatin to polyurethane is from 1:10 to 2:1.

12 Claims, No Drawings

BACKING LAYER FOR MOTION PICTURE FILM

CROSS REFERENCE TO RELATED APPLICATIONS

This application relates to commonly assigned copending application Ser. No. 09/90,579, filed simultaneously herewith. This application relates to commonly assigned copending application Ser. No. 09/090,576, filed simultaneously herewith. This application relates to commonly assigned copending application Ser. No. 09/090,578, filed simultaneously herewith. This application relates to commonly assigned copending application Ser. No. 09/90,827, filed simultaneously herewith.

FIELD OF THE INVENTION

The present invention relates to an improved motion picture film, and more particularly to a motion picture film that resists tar adsorption and stain absorption.

BACKGROUND OF THE INVENTION

Motion picture photographic films have long used a carbon black-containing layer on the backside of the film. This backside layer provides both antihalation protection and antistatic properties. The carbon black is applied in an alkali-soluble binder that allows the layer to be removed by a process that involves soaking the film in alkali solution, scrubbing the backside layer, and rinsing with water. This carbon black removal process, which takes place prior to image development, is both tedious and environmentally undesirable since large quantities of water are utilized in this film processing step. In addition, in order to facilitate removal during film processing, the carbon black-containing layer is not highly adherent to the photographic film support and may dislodge during various film manufacturing operations such as film slitting and film perforating. Carbon black debris generated during these operations may become lodged on the photographic emulsion and cause image defects during subsequent exposure and film processing.

After removal of the carbon black-containing layer the film's antistatic properties are lost. Undesired static charge build-up can then occur on processed motion picture film when transported through printers, projectors or on rewind equipment. Although these high static charges can discharge they cannot cause static marks on the processed photographic film. However, the high static charges can attract dirt particles to the film surface. Once on the film surface, these dirt particles can create abrasion or scratches or, if sufficiently large, the dirt particles may be seen on the projected film image.

In U.S. Pat. No. 5,679,505, a motion picture print film is described which contains on the backside of the support, an antistatic layer and a protective overcoat. The protective overcoat is comprised of a polyurethane binder and a lubricant. The polyurethane binder has a tensile elongation to break of at least 50% and a Young's modulus measured at 2% elongation of at least 50000 lb/in$^2$. The tough, flexible overcoat has excellent resistance to abrasion and scratching during manufacture, printing, and projection, while acting as an effective processing barrier for the underlying antistat layer.

However, post-processing tar deposits and stain have been a problem with protective overcoats in motion picture film. This tar is derived mostly from polymeric oxidized developer.

In copending commonly-assigned U.S. patent application Ser. No. 08/856,711, now U.S. Pat. No. 5,786,134, is described a motion picture film having a topcoat that resists processor tar pickup. The topcoat contains at least 20 percent by weight of a hydrophilic colloid such as gelatin. It would be desirable to provide a stain resistant topcoat of that resists processor tar stain, is readily manufactured and provides good physical properties.

SUMMARY OF THE INVENTION

The present invention is a motion picture film which includes a support having, in order, on one side thereof an antihalation undercoat and at least one silver halide emulsion layer and having, in order, on the opposite side thereof an antistatic layer and a protective overcoat. The protective overcoat includes a polyurethane binder having a tensile elongation to break of at least 50% and a Young's modulus measured at a 2% elongation of at least 50000 lb/in$^2$, and a topcoat farthest from the support. The topcoat is formed by the coating and subsequent drying of a coating composition comprising gelatin-grafted polyurethane comprising gelatin covalently bound to a polyurethane through a grafting agent, wherein the ratio of gelatin to polyurethane is from 1:10 to 2:1.

DETAILED DESCRIPTION OF THE INVENTION

This invention relates to a motion picture film having a support and having, in order, on one side thereof an antihalation undercoat and at least one silver halide emulsion layer and having, in order, on the opposite side thereof an antistatic layer, a protective overcoat; characterized in that said protective overcoat includes a polyurethane binder, the polyurethane binder has a tensile elongation to break of at least 50% and a Young's modulus measured at a 2% elongation of at least 50000 lb/in$^2$, and a topcoat farthest from the support which comprises a gelatin-grafted polyurethane. The topcoat is formed by the coating and subsequent drying of a coating composition comprising gelatin-grafted polyurethane comprising gelatin covalently bound to a polyurethane through a grafting agent, wherein the ratio of gelatin to polyurethane is from 1:10 to 2:1.

The photographic film support materials used in the practice of this invention are synthetic high molecular weight polymeric materials. These support materials may be comprised of various polymeric films, but polyester and cellulose triacetate film supports, which are well known in the art, are preferred. The thickness of the support is not critical. Support thickness of 2 to 10 mils (0.002–0.010 inches) can be employed, for example, with very satisfactory results. The polyester support typically employs an undercoat or primer layer between the antistatic layer and the polyester support. Such undercoat layers are well known in the art and comprise, for example, a vinylidene chloride/methyl acrylate/itaconic acid terpolymer or vinylidene chloride/acrylonitrile/acrylic acid terpolymer as described in U.S. Pat. Nos. 2,627,088, 2,698,235, 2,698,240, 2,943,937, 3,143,421, 3,201,249, 3,271,178 and 3,501,301.

The antihalation undercoat used in this invention functions to prevent light from being reflected into the silver halide emulsion layer(s) and thereby causing an undesired spreading of the image which is known as halation. Any of the filter dyes known to the photographic art can be used in the present invention as a means of reducing halation. Thus, for example, water-soluble dyes can be used for this purpose. Such dyes should be incorporated in the antihalation undercoat with a mordant to prevent dye diffusion. Alternatively, and preferably, a solid particle filter dye is incorporated in the antihalation undercoat.

Useful water-soluble filter dyes for the purpose of this invention include the pyrazolone oxonol dyes of U.S. Pat. No. 2,274,782, the solubilized diaryl azo dyes of U.S. Pat. No. 2,956,879, the solubilized styryl and butadienyl dyes of U.S. Pat. Nos. 3,423,207 and 3,384,487, the merocyanine dyes of U.S. Pat. No. 2,527,583, the merocyanine and oxonol dyes of U.S. Pat. Nos. 3,486,897, 3,652,284 and 3,718,472, the enamino hemioxonol dyes of U.S. Pat. No. 3,976,661, the cyanomethyl sulfone-derived merocyanines of U.S. Pat. No. 3,723,154, the thiazolidones, benzotriazoles, and thiazolothiazoles of U.S. Pat. Nos. 2,739,888, 3,253,921, 3,250,617, and 2,739,971, the triazoles of U.S. Pat. No. 3,004,896, and the hemioxonols of U.S. Pat. Nos. 34,215,597 and 4,045,229. Useful mordants are described, for example, in U.S. Pat. Nos. 3,282,699, 3,455,693, 3,438,779, and 3,795,519.

Preferred examples of solid particle filter dyes for use in the antihalation underlayer of this invention are those described in U.S. Pat. No. 4,940,654. These solid particle filter dyes are compounds represented by the following formula(I):

$$[D—A)_y]—X_n \quad (I)$$

where

D is a chromophoric light-absorbing moiety, which, when y is 0, comprises an aromatic ring free of carboxy substituents, A is an aromatic ring, free of carboxy substituents, bonded directly or indirectly to D, X is a substituent, other than carboxy, having an ionizable proton, either on A or on an aromatic ring portion of D, having a pKa of about 4 to 11 in a 50/50 mixture (volume basis) of ethanol and water, y is 0 to 4, n is 1 to 7, and the compound has a log partition coefficient of from about 0 to 6 when it is in unionized form.

Examples of filter dyes according to formula (I) include the following:

D-1

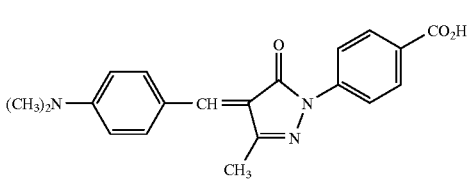

D-2

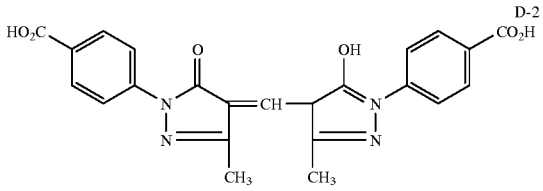

-continued

D-3

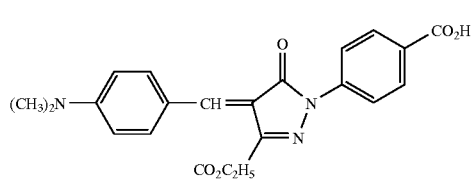

D-4

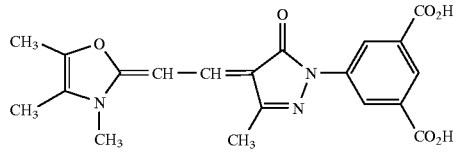

D-5

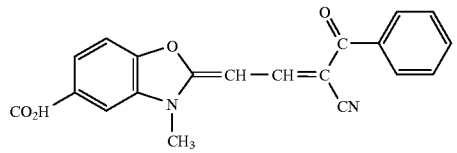

D-6

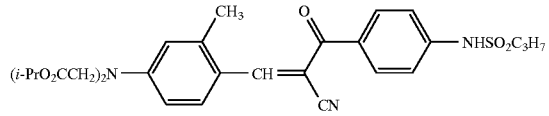

To promote adhesion of the antihalation underlayer to the support, primer layers as hereinabove described are advantageously employed, especially when the support is a polyester support.

The use of film-forming hydrophilic colloids as binders in photographic elements, including photographic films and photographic papers, is very well known. The most commonly used of these is gelatin and gelatin is a particularly preferred material for use in this invention. It can be used as the binder in the antihalation underlayer and in the silver halide emulsion layer(s). Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The photographic elements of the present invention can be simple black-and-white or monochrome elements or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to an antihalation underlayer and one or more emulsion layers, the elements of the present invention can contain auxiliary layers conventional in photographic elements, such as overcoat layers, spacer layers, filter layers, interlayers, pH lowering layers (sometimes referred to as acid layers and neutralizing layers), timing layers, opaque reflecting layers, opaque light-absorbing layers and the like.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure,* Item 36544, September, 1994, *Research Disclosure,* Item 38957, September, 1996, and the references listed therein.

The photographic silver halide emulsions utilized in this invention can contain other addenda conventional in the photographic art. Useful addenda are described, for example, in *Research Disclosure,* Item 36544, September, 1994 and *Research Disclosure,* Item 38957, September, 1996. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

Protective overcoats of the present invention may be successfully employed with a variety of antistatic layers well known in the art. The antistatic layer of this invention may include a variety of electrically conductive metal-containing particles, such as metal oxides, dispersed in a binder material. Many of these metal oxide particles do not require chemical barriers to protect them against harsh environments, such as photographic processing solutions. However, since many of these metal oxides require high particle loading in a binder to obtain good conductivity, i.e. antistatic properties, the physical properties are degraded and an abrasion resistant topcoat is required for good physical durability of the layers. Examples of useful electrically conductive metal-containing particles include donor-doped metal oxides, metal oxides containing oxygen deficiencies, and conductive nitrides, carbides, and borides. Specific examples of particularly useful particles include conductive $TiO_2$, $SnO_2$, $V_2O_5$, $Al_2O_3$, $ZrO_2$, $In_2O_3$, ZnO, $ZnSb_2O_6$, $InSbO_4$, $TiB_2$, $ZrB_2$, $NbB_2$, $TaB_2$, CrB, MoB, WB, $LaB_6$, ZrN, TiN, WC, HfC, HfN, and ZrC. Examples of the patents describing these electrically conductive particles include; U.S. Pat. Nos. 4,275,103, 4,394,441, 4,416,963, 4,418,141, 4,431,764, 4,495,276, 4,571,361, 4,999,276, 5,122,445 and 5,368,995. Also included are:

Semiconductive metal salts such as cuprous iodide as described in U.S. Pat. Nos. 3,245,833, 3,428,451, and 5,075,171.

Fibrous conductive powders comprising, for example, antimony-doped tin oxide coated onto non-conductive potassium titanate whiskers as described in U.S. Pat. Nos. 4,845,369 and 5,116,666.

Conductive polymers, such as, the cross-linked vinylbenzyl quaternary ammonium polymers of U.S. Pat. No. 4,070,189 or the conductive polyanilines of U.S. Pat. No. 4,237,194.

A colloidal gel of vanadium pentoxide or silver-doped vanadium pentoxide as described in U.S. Pat. Nos. 4,203,769, 5,006,451, 5,221,598 and 5,284,714.

However, the preferred antistatic layer contains vanadium pentoxide as described in one of the aforementioned patents. The antistatic layer described in U.S. Pat. No. 4,203,769 is prepared by coating an aqueous colloidal solution of vanadium pentoxide. Preferably, the vanadium pentoxide is doped with silver. A polymer binder, such as an anionic vinylidene chloride-containing terpolymer latex or a polyesterionomer dispersion, is preferably employed in the antistatic layer to improve the integrity of the layer and to improve adhesion to the undercoat layer. Typically the dried coating weight of the vanadium pentoxide antistatic material is about 0.5 to 30 $mg/m^2$. The weight ratio of polymer binder to vanadium pentoxide can range from about 1:5 to 500:1, but, preferably 1:1 to 10:1. Typically, the antistatic layer is coated at a dry coverage of from 1 to 400 $mg/m^2$ based on total dry weight. The electrical resistivity of the antistatic layer is preferably from about 7 to about 11 log Ω/sq, and most preferably less than 9 log Ω/sq.

The antistatic coating formulation may also contain a coating aid to improve coatability. The common level of coating aid in the antistatic coating formula is 0.01 to 0.30 weight percent active coating aid based on the total solution weight. However, the preferred level of coating aid is 0.02 to 0.20 weight percent active coating aid based on total solution weight. These coating aids can be either anionic or nonionic coating aids such as paraisononylphenoxy-glycidol ethers, octylphenoxy polyethoxy ethanol, sodium salt of alkylaryl polyether sulfonate, and dioctyl esters of sodium sulfosuccinic acid, which are commonly used in aqueous coatings. The coating may be applied onto the film support using coating methods well known in the art such as hopper coating, skim pan/air knife, gravure coating, and the like.

The antistatic layer of this invention is overcoated with a polyurethane. Preferably, the polyurethane is an aliphatic polyurethane. Aliphatic polyurethanes are preferred due to their excellent thermal and UV stability and freedom from yellowing. The polyurethanes of the present invention are characterized as those having a tensile elongation to break of at least 50% and a Young's modulus measured at an elongation of 2% of at least 50,000 $lb/in^2$. These physical property requirements insure that the overcoat layer is hard yet tough to simultaneously provide excellent abrasion resistance and outstanding resiliency to allow the topcoat and antistat layer to survive hundreds of cycles through a motion picture projector. The polyurethane overcoat is preferably coated from a coating formula containing from about 0.5 to about 10.0 weight percent of polymer to give a dry coverage of from about 50 to about 3000 mg/m$^2$. The dry coverage of the overcoat layer is preferably from about 300 to 2000 mg/m$^2$.

The polyurethane may be either organic solvent soluble or aqueous dispersible. For environmental reasons, aqueous dispersible polyurethanes are preferred. Water dispersible polyurethanes are well known and are prepared by chain extending a prepolymer containing terminal isocyanate groups with an active hydrogen compound, usually a diamine or diol. The prepolymer is formed by reacting a diol or polyol having terminal hydroxyl groups with excess diisocyanate or polyisocyanate. To permit dispersion in water, the prepolymer is functionalized with hydrophilic groups. Anionic, cationic, or nonionically stabilized prepolymers can be prepared.

Anionic dispersions contain usually either carboxylate or sulphonate functionalized co-monomers, e.g., suitably hindered dihydroxy carboxylic acids (dimethylol propionic acid) or dihydroxy sulphonic acids. Cationic systems are prepared by the incorporation of diols containing tertiary nitrogen atoms, which are converted to the quaternary ammonium ion by the addition of a suitable alkylating agent or acid. Nonionically stabilized prepolymers can be prepared by the use of diol or diisocyanate co-monomers bearing pendant polyethylene oxide chains. These result in polyurethanes with stability over a wide range of pH. Nonionic and anionic groups may be combined synergistically to yield "universal" urethane dispersions.

One of several different techniques may be used to prepare polyurethane dispersions. For example, the prepolymer may be formed, neutralized or alkylated if appropriate, then chain extended in an excess of organic solvent such as acetone or tetrahydrofuran. The prepolymer solution is then diluted with water and the solvent removed by distillation. This is known as the "acetone" process. Alternatively, a low molecular weight prepolymer can be prepared, usually in the presence of a small amount of solvent to reduce viscosity, and chain extended with diamine just after the prepolymer is dispersed into water. The latter is termed the "prepolymer mixing" process and for economic reasons is much preferred over the former.

Polyols useful for the preparation of polyurethane dispersions include polyester polyols prepared from a diol (e.g. ethylene glycol, butylene glycol, neopentyl glycol, hexane diol or mixtures of any of the above) and a dicarboxylic acid or an anhydride (succinic acid, adipic acid, suberic acid, azelaic acid, sebacic acid, phthalic acid, isophthalic acid, maleic acid and anhydrides of these acids), polylactones from lactones such as caprolactone reacted with a diol, polyethers such as polypropylene glycols, and hydroxyl terminated polyacrylics prepared by addition polymerization of acrylic esters such as the aforementioned alkyl acrylate or methacrylates with ethylenically unsaturated monomers containing functional groups such as carboxyl, hydroxyl, cyano groups and/or glycidyl groups.

Diisocyanates that can be used are as follows: toluene diisocyanate, tetramethylene diisocyanate, hexamethylene diisocyanate, isophorone diisocyanate, ethylethylene diisocyanate, 2,3-dimethylethylene diisocyanate, 1-methyltrimethylene diisocyanate, 1,3-cycopentylene diisocyanate, 1,4-cyclohexylene diisocyanate, 1,3-phenylene diisocyanate, 4,4'-biphenylene diisocyanate, 1,5-naphthalene diisocyanate, bis-(4-isocyanatocyclohexyl)-methane, 4,4'diisocyanatodiphenyl ether, tetramethyl xylene diisocyanate and the like.

Compounds that are reactive with the isocyanate groups and have a group capable of forming an anion are as follows: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, glucuronic acid and the like.

Suitable tertiary amines which are used to neutralize the acid and form an anionic group for water dispersibility are trimethylamine, triethylamine, dimethylaniline, diethylaniline, triphenylamine and the like. Diamines suitable for chain extension of the polyurethane include ethylenediamine, diaminopropane, hexamethylene diamine, hydrazine, aminoethylethanolamine and the like.

Solvents which may be employed to aid in formation of the prepolymer and to lower its viscosity and enhance water dispersibility include methylethylketone, toluene, tetrahydrofuran, acetone, dimethylformamide, N-methylpyrrolidone, and the like. Water-miscible solvents like N-methylpyrrolidone are much preferred.

The chemical resistance of the polyurethane overcoat can be improved by adding a crosslinking agent that reacts with functional groups present in the polyurethane, for example, carboxyl groups. Crosslinking agents such as aziridines, carbodiimides, epoxies, and the like are suitable for this purpose. The crosslinking agent can be used at about 0.5 to about 30 weight percent based on the polyurethane. However, a crosslinking agent concentration of about 2 to 12 weight percent based on the polyurethane is preferred.

The present invention includes a topcoat over the polyurethane protective overcoat to reduce or eliminate tar pickup. The topcoat contains a gelatin-grafted polyurethane. The polyurethanes useful in the topcoat of the present invention are water dispersible polyurethanes containing carboxylate groups, such as carboxylic acid or carboxylic acid salt groups, that are covalently bonded to gelatin with the aid of a grafting agent. The polyurethane dispersion may also contain nonionic groups in combination with the carboxylate groups. In order to provide sufficient carboxylate groups for grafting it is necessary that the polyurethane has an acid number of at least 5. Acid number is defined as the milligrams of KOH required to neutralize one gram of polymer.

The gelatin to be covalently bound to the polyurethane can be any of the known types of gelatin. These include, for example, alkali-treated gelatin (cattle bone or hide gelatin), acid-treated gelatin (pigskin or bone gelatin), and gelatin derivatives such as partially phthalated gelatin, acetylated gelatin, and the like, preferably the deionized gelatins. The gelatin covalently bound to the polyurethane may be crosslinked through the use of a coventional crosslinking agent. The ratio of gelatin to polyurethane is between 1 to 10 and 2 to 1, preferably between 1 to 4 and 2 to 1.

Suitable grafting agents that can be utilized for the attachment of gelatin to the polyurethane are the carbamoylonium salts, dication ethers, and carbodiimides described in U.S. Pat. No. 5,248,558, incorporated herein by reference. The carbamoylonium compounds useful in the practice of the present invention can be obtained commercially, or prepared using known procedures and starting materials, such as described in U.S. Pat. No. 4,421,847 and references noted therein, incorporated herein by reference. Representative preferred carbamoylonium compounds include 1-(4-morpholinocarbonyl)-4-(2-sulfoethyl)pyridinium hydroxide, inner salt, and 1-(4-morpholinocarbonyl) pyridinium chloride.

Dication ethers are also useful as grafting agents for bonding gelatin to a polyurethane containing carboxylate groups. Useful dication ethers have the formula:

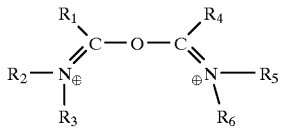

$2X^{\ominus}$

In this formula, $R_1$ represents hydrogen, alkyl, aralkyl, aryl, alkenyl, —$YR_7$, the group

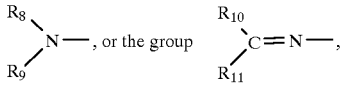

with Y representing sulfur or oxygen, and $R_7$, $R_8$, $R_9$, $R_{10}$, and $R_{11}$ each independently representing alkyl, alkyl, aralkyl, aryl, or alkenyl. Alternatively, $R_8$ and $R_9$, or $R_{10}$ and $R_{11}$ may together form a ring structure. $R_{10}$ and $R_{11}$ may each also represent hydrogen. Also, $R_1$ together with $R_2$ may form a heterocyclic ring.

$R_2$ and $R_3$ each independently represents alkyl, aralkyl, aryl, or alkenyl, or, combined with $R_1$ or each other, forms a heterocyclic ring. $R_4$, $R_5$, and $R_6$ are independently defined as are $R_1$, $R_2$, and $R_3$, respectively, and can be the same as or different from $R_1$, $R_2$, and $R_3$.

$X^-$represents an anion or an anionic portion of the compound to form an intramolecular (inner) salt. The ethers above can be made by techniques known to those skilled in the chemical synthesis art. Useful synthesis techniques include those described in *Journal Of American Chemical Society,* 103, 4839 (1981).

Carbodiimides can also be used to attach gelatin to carboxylated polyurethanes. Particularly preferred carbodiimide grafting agents are water-soluble carbodiimides of the formula:

$$R_{12}—N=C=N—R_{13}$$

wherein each of $R_{12}$ or $R_{13}$ is selected from: cycloalkyl having from 5 to 6 carbon atoms in the ring: alkyl of from 1 to 12 carbon atoms; monoarylsubstituted lower alkyl radicals, e.g., benzyl-α- and β-phenylethyl; monoaryl radicals, e.g., phenyl; morpholino; piperidyl; morpholinyl substituted with lower alkyl radicals, e.g., ethylmorpholinyl; piperidyl substituted with lower alkyl radicals, e.g., ethylpiperidyl; di-lower alkylamino; pyridyl substituted with lower alkyl radicals, e.g., α, β, γ-methyl-or ethyl-pyridyl; acid addition salts; and quaternary amines thereof.

For the grafting of gelatin to the polyurethane dispersion, the polyurethane dispersion is preferably first contacted with the grafting agent and then with gelatin, so that the gelatin preferentially reacts with the polyurethane, instead of gelatin-gelatin cross-linking. Carbamoylpyridinium and dication ether grafting agents are advantageously utilized in the practice of this invention as these may be employed to selectively bond to a carboxyl group on a polymer particle and then with an amino group on the gelatin molecule. Carbamoylpyridinium compounds are particularly preferred.

The contacting of the polyurethane and gelatin is preferably performed in an aqueous medium. The concentration of polyurethane in the aqueous dispersion is preferably less than about 25% and more preferably less than about 15% by weight. The concentration of gelatin in the aqueous dispersion is preferably less than about 25% and more preferably less than about 15% by weight.

The pH of the aqueous dispersion and the concentration of the polyurethane and gelatin should be adjusted to prevent bridging of gelatin molecules between the polyurethane dispersion, or coagulation. The pH of the gelatin is preferably maintained above the isoelectric pH of the gelatin (e.g., above 4.8 and preferably between 8 and 10 for lime-processed bone gelatin). Under such conditions, both the polyurethane dispersion and the gelatin should have the same charge, preferably negative, in order to minimize coagulation.

It is preferred for this invention that the gelatin-grafted polyurethane dispersion be washed extensively either by dialysis or diafiltration to remove traces of reaction byproducts and low molecular weight species.

The stain resistant topcoat of the present invention may comprise the gelatin-grafted polyurethane in combination with another polymer. In a preferred embodiment, the other polymer is a water soluble or water dispersible polymer. Water soluble polymers include, for example, gelatin, polyvinyl alcohol, polyvinyl pyrrolidone, cellulosics, polystyrene sulfonic acid and its alkali metal salts or ammonium salts, water soluble (meth)acrylic interpolymers, and the like. Water dispersible polymers that may be used in conjunction with the gelatin-grafted polyurethane include latex interpolymers containing ethylenically unsaturated monomers such as acrylic and methacrylic acid and their esters, styrene and its derivatives, vinyl chloride, vinylidene chloride, butadiene, acrylamides and methacrylamides, and the like. Other water dispersible polymers that may be used include polyurethane and polyester dispersions. Preferably, the stain resistant topcoat layer contains at least 50 weight % of the gelatin-grafted polyurethane.

The stain resistant topcoat compositions in accordance with the invention may also contain suitable crosslinking agents including aldehydes, epoxy compounds, polyfunctional aziridines, vinyl sulfones, methoxyalkyl melamines, triazines, polyisocyanates, dioxane derivatives such as dihydroxydioxane, carbodiimides, and the like. The crosslinking agents may react with the functional groups present on the gelatin-grafted polyurethane, and/or the other water soluble or water dispersible polymer present in the coating composition.

The topcoat may additionally contain fillers for improving the modulus of the layer, lubricants, and additives such as matte beads for controlling the ferrotyping characteristics of the surface.

Examples of reinforcing filler particles include inorganic powders with a Mohs scale hardness of at least 6. Specific examples are metal oxides such as g-aluminum oxide, chromium oxide, (e.g., $Cr_2O_3$), iron oxide (e.g., alpha-$Fe_2O_3$), tin oxide, doped tin oxide, such as antimony or indium doped tin oxide, silicon dioxide, alumino-silicate and titanium dioxide; carbides such as silicon carbide and titanium carbide; and diamond in fine powder.

A suitable lubricating agent can be included to give the topcoat a coefficient of friction that ensures good transport characteristics during manufacturing and customer handling of the photographic film. Many lubricating agents can be used, including higher alcohol esters of fatty acids, higher fatty acid calcium salts, metal stearates, silicone compounds, paraffins and the like as described in U.S. Pat. Nos. 2,588,756, 3,121,060, 3,295,979, 3,042,522 and 3,489,567. For satisfactory transport characteristics, the lubricated surface should have a coefficient of friction of from 0.10 to 0.40. However, the most preferred range is 0.15 to 0.30. If the topcoat coefficient of friction is below 0.15, there is a significant danger that long, slit rolls of the photographic film will become unstable in storage or shipping and become telescoped or dished, a condition common to unstable film rolls. If the coefficient of friction is above 0.30 at manufacture or becomes greater than 0.30 after photographic film processing, a common condition of non-process surviving topcoat lubricants, the photographic film transport characteristics become poorer, particularly in some types of photographic film projectors.

Aqueous dispersed lubricants are strongly preferred since lubricants, in this form, can be incorporated directly into the aqueous topcoat formula, thus avoiding a separately applied lubricant overcoat on the topcoat layer. The aqueous dispersed lubricants of carnauba wax, polyethylene oxide, microcrystalline wax, paraffin wax, silicones, stearates and amides work well as incorporated lubricants in the aqueous topcoat. However, the aqueous dispersed lubricants of carnauba wax and stearates are preferred for their effectiveness in controlling friction at low lubricant levels and their excellent compatibility with aqueous binders.

In addition to lubricants, matting agents are important for improving the transport of the film on manufacturing, printing, processing, and projecting equipment. Also, these matting agents can reduce the potential for the topcoat to ferrotype when in contact with the emulsion side surface under the pressures that are typical of roll films. The term "ferrotyping" is used to describe the condition in which the backside protective topcoat, when in contact with the emulsion side under pressure, as in a tightly wound roll, adheres to the emulsion side sufficiently strongly that some sticking is noticed between the protective topcoat and the emulsion side surface layer when they are separated. In severe cases of ferrotyping, damage to the emulsion side surface may occur when the protective topcoat and emulsion side surface layer are separated. This severe damage may have an adverse sensitometric effect on the emulsion.

The topcoat of the present invention may contain matte particles. The matting agent may be silica, calcium carbonate, or other mineral oxides, glass spheres, ground polymers and high melting point waxes, and polymeric matte beads. Polymeric matte beads are preferred because of uniformity of shape and uniformity of size distribution. The matte particles should have a mean diameter size of about 0.5 to about 3 micrometers. However, preferably the matte particles have a mean diameter of from about 0.75 to about 2.5 micrometers. The matte particles can be employed at a dry coating weight of about 1 to about 100 mg/m$^2$. The preferred coating weight of the matte particles is about 15 to about 65 mg/m$^2$. The surface roughness (Ra, ANSI Standard B46.1, 1985) in microns should be in the range 0.010 to 0.060 to prevent ferrotyping of the emulsion surface. The preferred Ra value range is from 0.025 to 0.045 for best performance. If the Ra value is below 0.025, there is insufficient surface roughness to prevent slight emulsion surface marking from ferrotyping between the backing and emulsion. If the Ra value is above 0.045, there is sufficient surface roughness with these size matte particles to show some low level of emulsion granularity and loss of picture sharpness, especially under the very high magnifications typical of movie theater projection.

The above described additives, including lubricants, matte beads, and fillers can also be present in the underlying polyurethane overcoat.

The stain resistant topcoat layers of the present invention may be applied from aqueous coating formulations containing up to 20% total solids by coating methods well known in the art. For example, hopper coating, gravure coating, skim pan/air knife coating, spray coating, and other methods may be used with very satisfactory results. The coatings are applied as part of the motion picture film support manufacturing process and are dried at temperatures up to 150° C. to give a dry coating weight of about 1 mg/m$^2$ to about 5000 mg/m$^2$, preferably, the dry coating weight is about 2 mg/m$^2$ to about 500 mg/m$^2$.

The present invention is illustrated by the following examples. However, it should be understood that the invention is not limited to these illustrative examples.

EXAMPLES

Preparation of Gelatin-Grafted Polyurethane Dispersions

Gelatin-Grafted Polyurethane P-1: A commercially available, water-dispersible glassy polyurethane (Sancure 898, a product of BF Goodrich) was grafted to gelatin at a weight ratio of 60 parts polyurethane to 40 parts gelatin by the following procedure: 80g of polyurethane dispersion (32% solids) and 145g distilled water were introduced to a 1 liter roundbottom 3-necked flask equipped with a condenser and overhead stirrer. The flask was immersed in a constant temperature bath at 60° C. 0.68g of 1-(4-morpholinocarbonyl)-4-(2-sulfoethyl)pyridinium hydroxide, inner salt was dissolved in 75g of water and added to the diluted polyurethane dispersion, an amount of grafting reagent equivalent to 20% of the polyurethane acid groups. Reaction was continued for 40 minutes, during which time 17.0g of gelatin was dissolved in 153g of water with heating at 60° C. and neutralized to pH 9 with triethylamine. The gelatin solution was then added via dropping funnel and the grafting reaction allowed to proceed for another 30 minutes. After cooling to 40° C. the product was filtered, with very little insoluble matter observed, then refrigerated. The gelatin-grafted polyurethane dispersion so obtained was stable to storage for months.

Gelatin-Grafted Polyurethane P-2: A water-dispersible rubbery polyurethane (Witcobond 236, a product of Witco Corp.) was grafted to gelatin by the same process employed in Example 1.213g of polyurethane dispersion at 20% solids was further diluted with 200g water and allowed to react with 1.1g of 1-(4-morpholinocarbonyl)-4-(2-sulfoethyl) pyridinium hydroxide, inner salt for 45 minutes at 60° C. 278g of a 10% solids pH 9 gelatin solution was then added and reaction continued for 40 minutes. This product was refrigerated without filtration and was observed to contain no insolubles when remelted 2 months after preparation.

Preparation of Support Containing an Antistatic Formulation

A subbed polyester support was prepared by first applying a subbing terpolymer of acrylonitrile, vinylidene chloride and acrylic acid to both sides of the support before drafting and tentering so that the final coating weight was about 90 mg/m$^2$.

An antistatic formulation consisting of the following components was prepared at 0.078% total solids:

| | |
|---|---|
| Terpolymer of acrylonitrile, vinylidene chloride and acrylic acid, | 0.094% |
| Vanadium pentoxide colloidal dispersion, 0.57% | 4.972% |
| Rohm & Haas surfactant, Triton X-100, 10% | 0.212% |
| Demineralized water | 94.722% |

The antistatic formulation was coated over the subbed polyester support on the side opposite to the antihalation layer to give a dry coating weight of about 12 mg/m$^2$.

Comparative Sample A comprised the following: a protective overcoat formulation was applied over the antistat layer. The overcoat formulation consisted of the following components:

| | Dry Coverage, mg/m$^2$ |
|---|---|
| Polyurethane dispersion, 32% Sancure 898, B. F. Goodrich Corp. | 972 |
| Carnauba wax dispersion, Michemlube 160, 25% | 0.65 |
| Matte, polymethyl methacrylate beads, 1.47 $\mu$m, 23.8% | 26.9 |
| Polyfunctional aziridine crosslinker Zeneca Resins Inc. CX-100, 50% | 60.8 |
| Rohm & Haas surfactant, Triton X-100, 10% | 10.8 |

A urethane overcoat identical to Comparative Sample A—excepting the carnauba wax was omitted—was prepared and the topcoats described in Table 1 were applied. Comparative Sample B comprised a topcoat that contained only 20 wt % of a gelatin-grafted polyurethane.

Tar Test

During routine film development, by-products of oxidized color developer will form brown, oily residue that may be adsorbed by the film surface and may create permanent, brown stained spots, i.e. tar.

A simulated developer tar test was performed on the samples to determine their propensity for tar/stain build-up. The test was done at 42° C. and involved smearing tar harvested from a developer tank onto the coating immersed in a developer bath followed by removal of the tar using dilute sulfuric acid. The resultant stain or tar is indicative of the propensity of the coating for tar adsorption. The resistance to tar stain was visually rated on a scale of 1 to 5, with 1 being the best performance, (i.e., no tar stain) and 5 being the worst performance (i.e., severe tar stain). The results are tabulated in Table 1.

TABLE 1

| Coating | Composition | Dry Coverage mg/m$^2$ | Tar Stain Rating |
|---|---|---|---|
| Comparative Sample A | Polyurethane protective overcoat only | 1000 | 5 |
| Example 1 | P-1 | 20 | 2 |
| Example 2 | P-1 | 50 | 2 |
| Example 3 | P-1 | 100 | 1 |
| Example 4 | P-1 | 200 | 1 |
| Example 5 | P-2 | 100 | 1 |
| Comparative Sample B | P-1/Sancure 898 polyurethane, 20/80 | 200 | 4 |

As shown in Comparative Sample A, the polyurethane coating has very poor resistance to picking up developer tar, as does Comparative Sample B. In contrast, the coatings of the invention exhibit excellent resistance to tar stain, even when employed as extremely thin layers relative to the underlying polyurethane. In addition, the coatings of the invention were transparent and had excellent adhesion to the polyurethane.

The invention has been described in detail with particular reference to certain preferred embodiments thereof, but it will be understood that variations and modifications can be effected within the spirit and scope of the invention.

What is claimed is:

1. A motion picture film comprising a support having, in order, on one side thereof an antihalation undercoat and at least one silver halide emulsion layer and having, in order, on an opposite side thereof an antistatic layer, a protective overcoat; characterized in that said protective overcoat is comprised of a polyurethane binder and said polyurethane binder has a tensile elongation to break of at least 50% and a Young's modulus measured at a 2% elongation of at least 50000 lb/in$^2$, and a topcoat farthest from said support formed by the coating and subsequent drying of a coating composition comprising gelatin-grafted polyurethane comprising gelatin covalently bound to a polyurethane through a grafting agent, wherein a ratio of gelatin to polyurethane is from 1:10 to 2:1.

2. The motion picture film of claim 1, wherein said antihalation undercoat comprises a solid particle filter dye.

3. The motion picture film of claim 1, wherein said antistatic layer comprises electrically-conductive metal-containing particles selected from the group consisting of donor-doped metal oxides, metal oxides containing oxygen deficiencies, conductive nitrides, conductive carbides and conductive borides.

4. The motion picture film of claim 1, wherein said antistatic layer comprises an electrically-conductive polymer.

5. The motion picture film of claim 1, wherein said antistatic layer comprises vanadium pentoxide.

6. The motion picture film of claim 1, wherein said antistatic layer has a dry coverage of from 1 to 400 mg/m$^2$.

7. The motion picture film of claim 1, wherein said polyurethane binder has a dry coverage of from 50 to 3000 mg/m$^2$.

8. The motion picture film of claim 1, wherein said grafting agent comprises carbamoylonium salts, dication ethers or carbodiimides.

9. The motion picture film of claim 1, wherein said coating composition further comprises another polymer selected from the group consisting of water soluble polymers or water dispersible polymers.

10. The motion picture film of claim 1, wherein the topcoat layer contains at least 50 weight % of the gelatin-grafted polyurethane.

11. The motion picture film of claim 1, wherein the topcoat further comprises crosslinking agents, fillers, lubricating agents or matting agents.

12. The motion picture film of claim 1, wherein the polyurethane binder further comprises lubricants, matte beads or fillers.

* * * * *